US008165515B2

(12) United States Patent
Nishikata et al.

(10) Patent No.: US 8,165,515 B2
(45) **Date of Patent: *Apr. 24, 2012**

(54) IMAGE FORMING SYSTEM

(75) Inventors: Akinobu Nishikata, Abiko (JP); Satoru Yamamoto, Abiko (JP)

(73) Assignee: Canon Kabushiki Kaisha (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/052,449

(22) Filed: Mar. 21, 2011

(65) Prior Publication Data

US 2011/0170887 A1 Jul. 14, 2011

Related U.S. Application Data

(63) Continuation of application No. 11/758,423, filed on Jun. 5, 2007, now Pat. No. 7,933,544.

(30) Foreign Application Priority Data

Jun. 6, 2006 (JP) ..... 2006-157296

(51) Int. Cl.
*G03G 15/00* (2006.01)

(52) U.S. Cl. ..... 399/341; 399/342; 399/407

(58) Field of Classification Search ..... 399/341
See application file for complete search history.

(56) References Cited

U.S. PATENT DOCUMENTS

| | | | | |
|---|---|---|---|---|
| 4,828,950 | A | 5/1989 | Crandall | |
| 5,890,032 | A | 3/1999 | Aslam et al. | |
| 6,226,473 | B1 | 5/2001 | Kutsuwada | |
| 7,933,544 | B2 * | 4/2011 | Nishikata et al. | 399/341 |
| 2002/0098022 | A1 * | 7/2002 | Kabashima | 399/341 |
| 2003/0007814 | A1 | 1/2003 | Richards | |
| 2005/0052693 | A1 | 3/2005 | Kadota | |
| 2006/0127143 | A1 | 6/2006 | Tamura et al. | |
| 2006/0133870 | A1 | 6/2006 | Ng et al. | |
| 2006/0216048 | A1 | 9/2006 | Fujii et al. | |

FOREIGN PATENT DOCUMENTS

| | | | |
|---|---|---|---|
| JP | 03-013079 | A | 1/1991 |
| JP | 2000-019799 | A | 1/2000 |
| JP | 2003-207954 | A | 7/2003 |
| JP | 2005242348 | A | 9/2005 |

OTHER PUBLICATIONS

Office Action issued Aug. 22, 2011 for corresponding Japanese Patent Application No. 2006-157296.

* cited by examiner

*Primary Examiner* — Daniel J Colilla
*Assistant Examiner* — Allister Primo
(74) *Attorney, Agent, or Firm* — Rossi, Kimms & McDowell LLP

(57) ABSTRACT

An image forming system which is capable of causing a clear coating apparatus to discharge processed sheets in proper page order, and improving usability and operability of the system by users. An image forming apparatus is set to perform single-sided image formation or double-sided image formation. A clear coating apparatus is set to perform single-sided clearing coating or double-sided clear coating. Whether to perform inverted discharge of sheets is controlled according to the settings of the image forming apparatus and the clear coating apparatus.

7 Claims, 9 Drawing Sheets

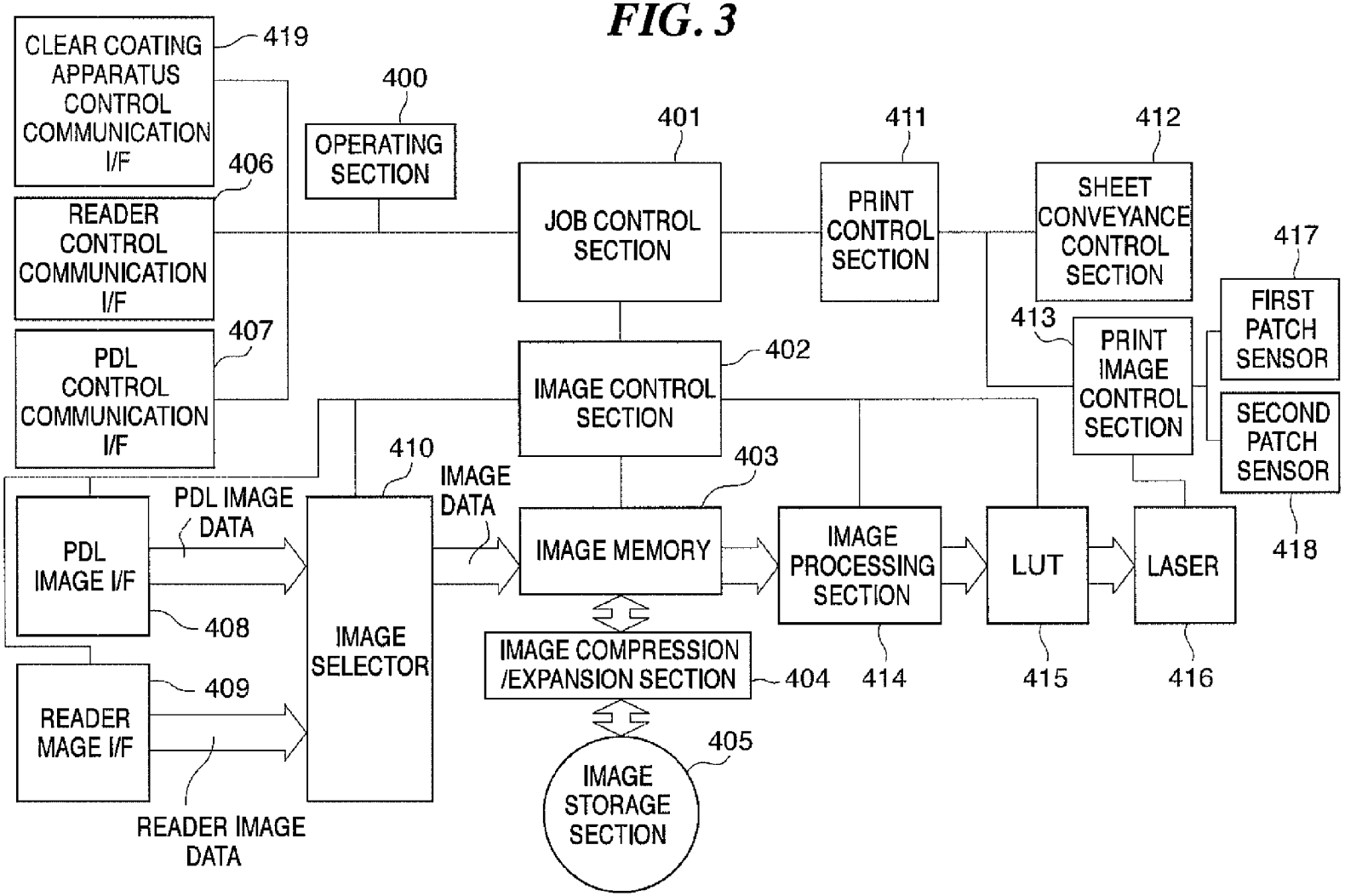
FIG. 3
JOB CONTROL SECTION
401
IMAGE CONTROL SECTION
402
IMAGE MEMORY
403
IMAGE COMPRESSION /EXPANSION SECTION
404
IMAGE STORAGE SECTION
405
IMAGE PROCESSING SECTION
414
LUT
415
LASER
416
PRINT CONTROL SECTION
411
SHEET CONVEYANCE CONTROL SECTION
412
PRINT IMAGE CONTROL SECTION
413
FIRST PATCH SENSOR
417
SECOND PATCH SENSOR
418
OPERATING SECTION
400
IMAGE SELECTOR
410
IMAGE DATA
CLEAR COATING APPARATUS CONTROL COMMUNICATION I/F
419
READER CONTROL COMMUNICATION I/F
406
PDL CONTROL COMMUNICATION I/F
407
PDL IMAGE DATA
PDL IMAGE I/F
408
READER MAGE I/F
409
READER IMAGE DATA

*FIG. 7*

| | | IMAGE FORMATION MODE | |
|---|---|---|---|
| | | SINGLE | DOUBLE-SIDED |
| CLEAR COATING MODE | INHIBITED | INVERT | NOT INVERT |
| | SINGLE | INVERT | — |
| | DOUBLE-SIDED | NOT INVERT | INVERT |

IMAGE FORMING SYSTEM

This is a continuation of patent application Ser. No. 11/758,423 filed Jun. 5, 2007, the disclosure of which is hereby incorporated by reference herein in its entirety.

BACKGROUND OF THE INVENTION

1. Field of the Invention

The present invention relates to an image forming system comprised of an image forming apparatus that forms an image on a sheet, and a clear coating apparatus connected to the image forming apparatus on a downstream side of the same so as to perform clear coating on the sheet using clear toner which becomes clear (transparent) after being fixed on the sheet.

2. Description of the Related Art

In recent years, there has been an increasing demand for full-color electrophotographic image forming apparatuses ensuring high image quality. Further, it has been increasingly desired to realize a high-quality photographic tone image mode in an electrophotographic image forming apparatus, with proliferation of digital cameras as a major reason.

Further, there has been proposed an image forming system that is comprised of an image forming apparatus and a clear coating apparatus continuously connected thereto, and is configured to form a high-quality photographic tone image on a sheet, and then place thereon a toner image which becomes transparent when fixed, to thereby perform clear coating on the formed image (see e.g. Japanese Laid-Open Patent Publication (Kokai) No. H03-13079).

Further, there has been a system including apparatuses continuously connected to each other, in which an upstream one of the continuously connected apparatuses performs printing on a first surface of a sheet, and a downstream one of the apparatuses performs printing on a second surface of the sheet, to thereby realize double-sided printing without the provision of a sheet-inverting mechanism (see e.g. Japanese Laid-Open Patent Publication (Kokai) No. 2003-207954).

The above system with the continuously connected apparatuses is aimed at improving productivity, and hence double-sided printing is not performed within any of the apparatuses. Therefore, when the upstream one of the apparatuses performs double-sided printing on each sheet and discharges the sheet, according to a conventional job sequence, if the downstream one of the apparatuses also perform double-sided printing on the sheet, this causes the problem of an improper page order of the discharged printed sheets.

SUMMARY OF THE INVENTION

The present invention provides an image forming system which is capable of causing a clear coating apparatus to discharge processed sheets in proper page order, and improving usability and operability of the system by users.

In a first aspect of the present invention, there is provided an image forming system including an image forming apparatus that performs image formation on sheets, and a clear coating apparatus that performs clear coating using a clear toner, comprising an inverted discharge section adapted to discharge each sheet after inverting the sheet upside down, a setting unit adapted to set the image forming apparatus such that the image forming apparatus performs single-sided image formation or double-sided image formation, and set the clear coating apparatus such that clear coating apparatus performs single-sided clearing coating or double-sided clear coating, and a controller adapted to control the inverted discharge section according to settings of the image forming apparatus and the clear coating apparatus by the setting unit.

The image forming system according to the first aspect of the present invention comprises the controller that controls the inverted discharge section according to a combination of an image forming mode (single-sided image formation or double-sided image formation) of the image forming apparatus and a clear coat image-forming mode (single-sided clear coating or double-sided clear coating) of the clear coating apparatus. Therefore, it is possible to cause the clear coating apparatus to discharge the sheets in proper page order, and improve usability and operability of the system by users.

When performing image formation on a plurality of sheets and discharge the sheets out of the clear coating apparatus in a predetermined order, the controller can control the inverted discharge section to invert each sheet upside down, when the setting unit configures the settings to cause the image forming apparatus to perform double-sided image formation and cause the clear coating apparatus to perform double-sided clear coating.

The controller can control the inverted discharge section not to invert each sheet upside down, when the setting unit configures the settings to cause the image forming apparatus to perform double-sided image formation and cause the clear coating apparatus not to perform clear coating.

The controller can control the inverted discharge section not to invert each sheet upside down, when the setting unit configures the settings to cause the image forming apparatus to perform single-sided image formation and cause the clear coating apparatus to perform double-sided clear coating.

When performing image formation on a plurality of sheets and discharge the sheets out of the clear coating apparatus in a predetermined order, the controller can control the inverted discharge section to invert each sheet upside down, when the setting unit configures the settings to cause the image forming apparatus to perform single-sided image formation and cause the clear coating apparatus to perform single-sided clear coating.

When performing image formation on a plurality of sheets and discharge the sheets out of the clear coating apparatus in a predetermined order, the controller controls the inverted discharge section to invert each sheet upside down, when the setting unit configures the settings to cause the image forming apparatus to perform single-sided image formation and cause the clear coating apparatus not to perform clear coating.

In a second aspect of the present invention, there is provided an image forming system including an image forming apparatus that performs image formation on sheets, and a clear coating apparatus that performs clear coating using a clear toner, comprising an inverted discharge section adapted to discharge each sheet after inverting the sheet upside down, a setting unit adapted to set the image forming apparatus such that the image forming apparatus performs single-sided image formation or double-sided image formation, and set the clear coating apparatus such that clear coating apparatus performs single-sided clearing coating or double-sided clear coating, and an image formation order-changing section adapted to change an order of pages of each sheet to be subjected to image formation by the image forming apparatus.

The image forming system according to the second aspect of the present invention includes an image forming order-changing section that changes an order of pages according to a combination of the image forming mode (single-sided image formation or double-sided image formation) of the image forming apparatus and the clear coat image-forming mode (single-sided clear coating or double-sided clear coating) of the clear coating apparatus. Therefore, it is possible to cause the clear coating apparatus to discharge the sheets in proper page order, and improve usability and operability of the system by users.

When performing image formation on a plurality of sheets and discharge the sheets out of the clear coating apparatus in a predetermined order, the image formation order-changing section reverses the order of pages of each sheet to be subjected to double-sided image formation by the image forming apparatus, when the setting unit configures the settings to cause the image forming apparatus to perform double-sided image formation and cause the clear coating apparatus to perform double-sided clear coating.

The image formation order-changing section can set the order of pages of each sheet to be subjected to double-sided image formation by the image forming apparatus, to a normal page order, when the setting unit configures the settings to cause the image forming apparatus to perform double-sided image formation and cause the clear coating apparatus not to perform clear coating.

The above and other objects, features, and advantages of the invention will become more apparent from the following detailed description taken in conjunction with the accompanying drawings.

BRIEF DESCRIPTION OF THE DRAWINGS

FIG. 3 is a schematic diagram of the circuit configuration of the image forming apparatus.

FIG. 7 is a diagram of a table showing the relationship between an image formation mode of the image forming apparatus, a clear coating mode of the clear coating apparatus, and an inverted discharge operation set to the clear coating apparatus.

DETAILED DESCRIPTION OF THE PREFERRED EMBODIMENTS

The present invention will now be described in detail below with reference to the drawings showing preferred embodiments thereof.

Figure 1:
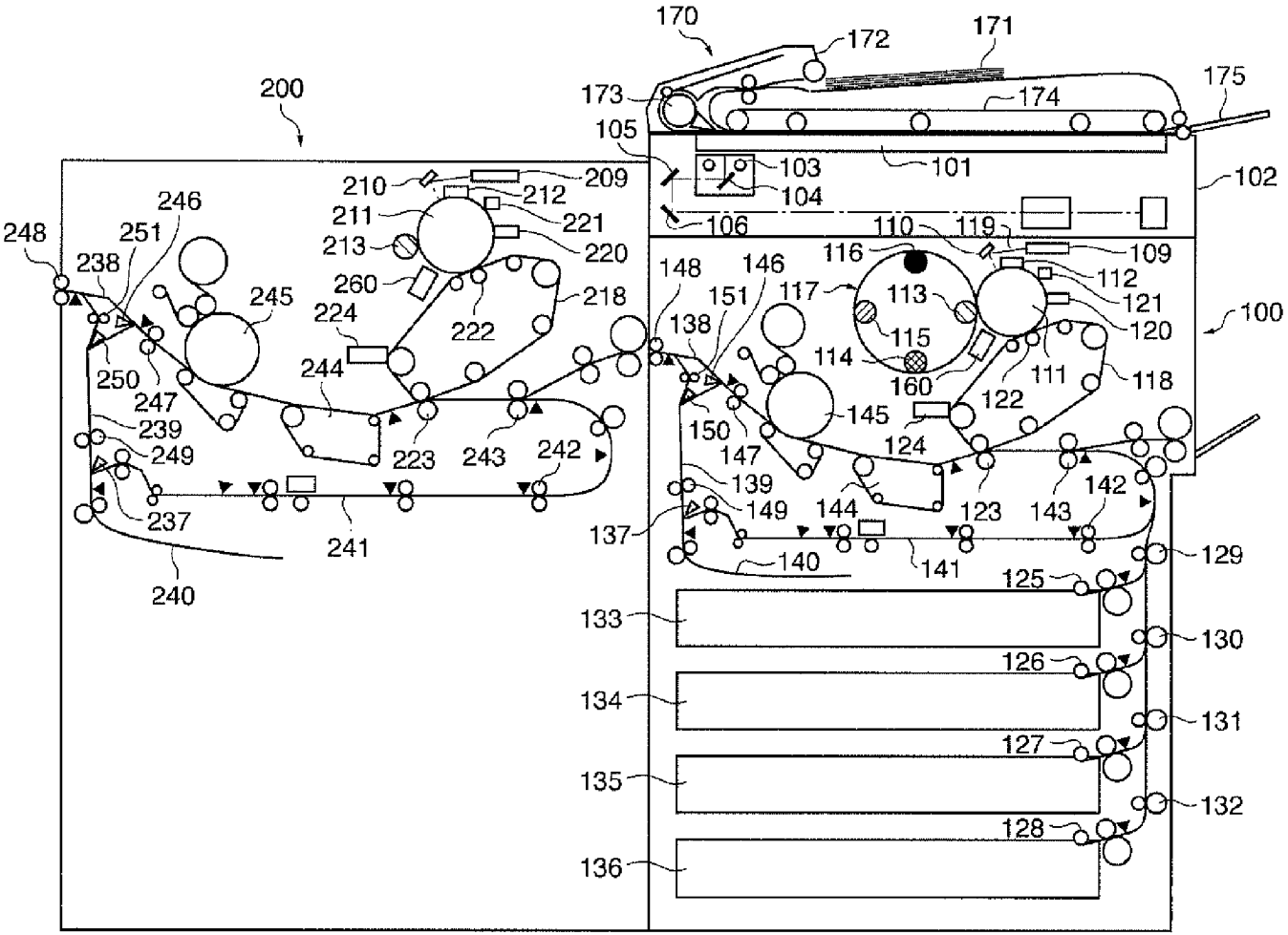
FIG. 1 is a schematic view of an image forming system according to a first embodiment of the present invention.

FIG. 1 is a schematic view of an image forming system according to the first embodiment of the present invention.

As shown in FIG. 1, the image forming system according to the present embodiment is comprised of an image forming apparatus 100, and a clear coating apparatus 200 connected to the image forming apparatus 100 on a downstream side of the same. In the present embodiment, the image forming apparatus 100 is described as a color image forming apparatus, but it may be a monochrome one.

The image forming apparatus 100 includes a platen glass 101 as an original platen, and a scanner 102. The scanner 102 is comprised of an original illuminating lamp 103, scanning mirrors 104 to 106, a lens 107, and an image sensor unit 108.

The scanner 102 is driven by a motor, not shown, to reciprocate for scanning in a predetermined direction. During this motion of the scanner 102, a reflected light from an original passes through the lens 107 via the scanning mirrors 104 to 106 to form an image on a CCD sensor provided in the image sensor unit 108.

The exposure controller 109 is comprised of a laser, a polygon scanner, and so forth. The exposure controller 109 causes a laser beam 119 modulated based on an image signal converted into an electric signal by the image sensor unit 108 and having undergone predetermined image processing, referred to hereinafter, to reflect on a reflecting mirror 110 to thereby irradiate a photosensitive drum 111 with the laser beam 119. The exposure controller 109 of the image forming apparatus 100 will be described in more detail hereinafter with reference to FIG. 3.

Around the photosensitive drum 111, there are arranged a pre-exposure lamp 121 for erasing potential on the photosensitive drum 111, and a primary electrostatic charger 112 for applying potential to the photosensitive drum 111. The primary electrostatic charger 112 applies a high voltage to a wire to thereby generate corona discharge.

Further, around the photosensitive drum 111, there are arranged a developing rotary 117, an intermediate transfer member 118 for temporarily holding thereon an image developed on the photosensitive drum 111, a primary transfer roller 122 for transferring the image onto the intermediate transfer member 118, and a photosensitive drum cleaner 120.

Developing devices 113 to 116 filled with toners for developing an electrostatic latent image formed by irradiating the photosensitive drum 111 with the laser beam 119 are housed in the developing rotary 117 that sequentially brings the developing devices 113 to 116 into contact with the photosensitive drum 111.

The photosensitive drum 111 is rotated by a motor, not shown, and is charged to a desired potential by the primary electrostatic charger 112. Then, the laser beam 119 emitted from the exposure controller 109 is reflected on the reflecting mirror 110 to be irradiated onto the photosensitive drum 111. This causes an electrostatic latent image to be formed on the photosensitive drum 111.

The developing rotary 117 rotates to bring the developing device 113 for a first color into contact with the photosensitive drum 111 and electrostatically applies a toner from the developing device 113 onto the electrostatic latent image on the photosensitive drum 111 to thereby form a toner image on the photosensitive drum 111.

In the case of forming a full-color image with toners of four colors contained in the respective developing devices 113 to 116, the first-color toner image developed on the photosensitive drum 111 is primarily transferred onto the intermediate transfer member 118 by the primary transfer roller 122. Then, the developing rotary 117 rotates to bring the developing device 114 for a second color into contact with the photosensitive drum 111.

At this time, the laser beam 119 is emitted again from the exposure controller 109 in timing in which the leading end of the first-color toner image primarily transferred onto the intermediate transfer member 118 and that of a second-color toner image to be developed on the photosensitive drum 111 are perfectly aligned with each other at a position corresponding to the primary transfer roller 122.

Similarly to the first-color toner image, the second-color toner image is formed on the photosensitive drum 111 by the developing device 114 for the second color being brought into contact with the drum 111. The toner image is superimposed by the primary transfer roller 122 on the first-color toner image primarily transferred onto the intermediate transfer member 118. This superimposing operation is repeatedly carried out for a third color and a fourth color, whereby the full-color developed image of the four colors is eventually transferred onto the intermediate transfer member 118.

A sheet is fed from one of a first sheet feed cassette 133, a second sheet feed cassette 134, a third sheet feed cassette 135, and a fourth sheet feed cassette 136 by an associated one of pickup rollers 125 to 128. The sheet fed from the sheet feed cassette is conveyed toward a registration roller 143 by an associated one of feed rollers 129 to 132.

The sheet is conveyed to the vicinity of the registration roller 143 at rest, and then conveyed to a secondary transfer roller 123 by the registration roller 143 when the registration roller 143 is driven such that the leading end of the sheet is aligned with that of the developed image transferred onto the intermediate transfer member 118. Then, a transfer bias is applied to the secondary transfer roller 123, whereby the image is secondarily transferred onto the sheet. Thereafter, the sheet is conveyed to a conveyor belt 144.

On the intermediate transfer member 118, there remains residual toner which was not transferred onto the sheet by the secondary transfer roller 123. The residual toner is cleaned by an intermediate transfer member cleaner 124. The intermediate transfer member cleaner 124 is disposed in a manner contactable with the intermediate transfer member 118, and comes into contact with the intermediate transfer member 118 immediately before the leading end of the residual toner of the secondarily transferred image reaches the intermediate transfer member cleaner 124.

Then, the intermediate transfer member cleaner 124 is controlled to move apart from the intermediate transfer member 118 immediately before the leading end of a first-color developed image of a next toner image, which was transferred onto the intermediate transfer member 118 by the primary transfer roller 122, reaches the intermediate transfer member cleaner 124.

There also remains residual toner on the photosensitive drum 111 after the toner image thereon has been transferred onto the intermediate transfer member 118. This residual toner is cleaned by a photosensitive drum cleaner 120. Thereafter, residual charge on the photosensitive drum 111 is erased by the pre-exposure lamp 121.

The sheet with the image secondarily transferred from the intermediate transfer member 118 is conveyed to a fixing device 145 by the conveyor belt 144. The fixing device 145 is comprised of an upper heat roller, and a fixing belt for being pressed against the heat roller from below. The toner image secondarily transferred onto the sheet is fixed on the sheet by being pressed and heated by the fixing device 145. Then, the sheet is discharged from the image forming apparatus 100 by an inner discharge roller 147 and an outer discharge roller 148.

In FIG. 1, a discharge flapper 146 switches the course of a sheet between a conveying path 138 and an inverting path 139. In the case of double-sided recording (double-sided image formation) for forming images on the respective opposite sides of a sheet, a sheet conveyed by the inner discharge roller 147 is advanced into the inverting path 139 by shifting the discharge flapper 146 upward, and conveyed into an inversion conveying path 140.

Thereafter, the advancing direction of the sheet is reversed by switching a flapper 137, whereby the sheet is guided into a refeed path 141 in an inverted state. On a fore end of the refeed path 141, there is disposed a refeed roller 142 for refeeding the sheet to an image forming position (transfer position).

The outer discharge roller 148 is disposed in the vicinity of the discharge flapper 146, and a sheet whose course is switched to the conveying path 138 by the discharge flapper 146 is discharged from the image forming apparatus 100 by the outer discharge roller 148. In the case of discharging a sheet from the image forming apparatus 100 after inverting the same, the discharge flapper 146 is shifted upward, and the sheet is conveyed into the inverting path 139 by an inverting roller 149 until the trailing end of the sheet passes by an inverting flapper 150. Then, the inverting flapper 150 is switched, and the inverting roller 149 is reversely rotated, whereby the sheet is conveyed toward the outer discharge roller 148 after being inverted.

An automatic document feeder (ADF) 170 automatically feeds an original to a position where the original can be read by the scanner 102.

The ADF 170 is comprised of an original tray 171 on which a maximum of one hundred originals can be placed, an original feed roller 172 for feeding originals, an original side inverting roller 173 for enabling double-sided reading of an original fed by the original feed roller 172, and an original conveying belt 174.

The original conveying belt 174 conveys an original conveyed by the original feed roller 172 or the original side inverting roller 173, onto the platen glass 101. The original conveying belt 174 is controlled to stop the original in a reading position, and then discharge the original onto an original discharge tray 175, provided that in the case of reading the reverse side of the original, it is controlled to return the original to the original side inverting roller 173 before discharging the same onto the original discharge tray 175. The original discharge tray 175 can also have a maximum of one hundred originals loaded thereon.

Units of the clear coating apparatus 200, which are designated by respective numerals 209 to 250 correspond to the units of the image forming apparatus 100, which are designated by respective numerals 109 to 150, and therefore duplicate description thereof is omitted.

An exposure controller 209 of the clear coating apparatus 200 will be described in detail hereinafter with reference to FIG. 4. A developing device 213 contains a clear-colored toner. The clear toner originally has a whitish color, and becomes clear or transparent when heated by a fixing device.

A sheet with an image formed by the image forming apparatus 100 is conveyed into the clear coating apparatus 200 by the outer discharge roller 148. The sheet is received by a roller in the clear coating apparatus 200 and conveyed toward a registration roller 243. An image forming operation and sheet conveying and discharging operations carried out thereafter are the same as those performed by the image forming apparatus 100.

Figure 2:
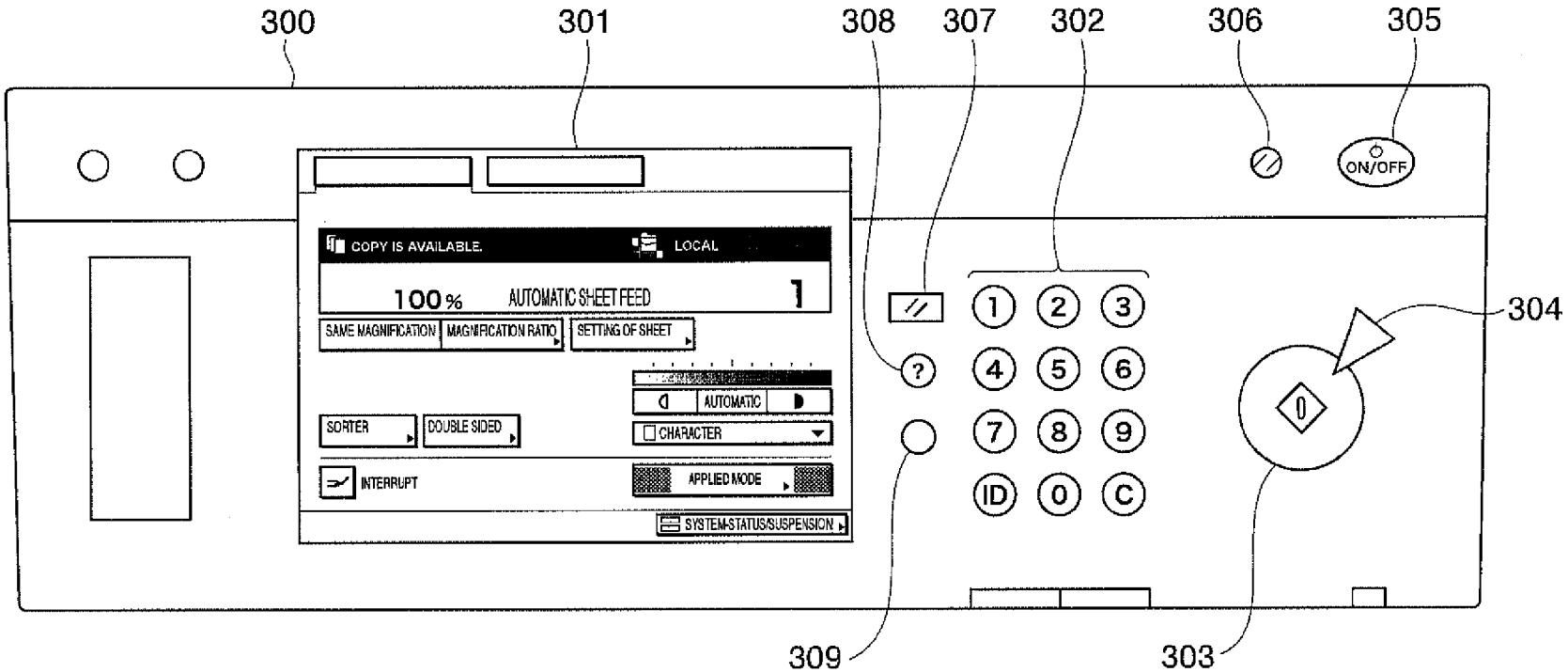
FIG. 2 is a view of an operation panel of an image forming apparatus appearing in FIG. 1.

FIG. 2 is a view of an operation panel of the image forming apparatus 100 in FIG. 1.

As shown in FIG. 2, the operation panel 300 is comprised of an LCD display section 301, a ten-key numeric keypad 302, a start key 303, a stop key 304, a soft power key 305, a power-saving mode key 306, a reset key 307, a guide key 308, and a user mode key 309.

The touch panel-type LCD display section 301 is used to perform mode setting and status display. The ten-key numeric keypad 302 is comprised of input keys for inputting numerals 0 to 9 and a clear key for returning a set value to a default value. The start key 303 is pressed by the user so as to execute a copying function or a scanning function.

The stop key 304 is pressed by the user so as to stop a job which is being carried out using the copying function, the printing function, or the scanning function. The soft power key 305 is pressed by the user so as to turn off the powers of respective loads, such as motors, of the image forming apparatus 100, and keep a CPU and networking active.

The power-saving mode key 306 is pressed by the user so as to perform temperature adjustment control of the fixing device 145 at a level set in a user mode. The reset key 307 is pressed so as to reset a function set via the LCD display section 301 or the ten-key numeric keypad 302 to a default value.

The guide key 308 is pressed by the user so as to display an explanation of each of the copying function, the printing function, the scanning function, and user modes to be set/executed.

The user mode key 309 is pressed by the user so as to set an adjustment mode for executing an adjustment item, such as gradation correction, which the user is allowed to execute as desired, as well as to carry out various kinds of network configurations, including IP address setting.

The user can designate an operation mode, such as a single-sided clear coating mode or a double-sided clear coating mode, by operating the operation panel 300.

FIG. 3 is a schematic diagram of the circuit configuration of the image forming apparatus 100 in FIG. 1.

Referring to FIG. 3, an operating section 400 is a circuit for controlling the operation panel 300 shown in FIG. 2. A job controller 401 is a circuit including a ROM in which are written programs for controlling the image forming apparatus 100, a RAM in which the programs are loaded, and a CPU that executes the programs.

The operating section 400 is connected to the job controller 401, and the job controller 401 is notified of an operation mode designated via the operating section 400. The job controller 401 generates a copy job, a scan job, or the like according to received operation mode information, based on a program stored in the job controller 401.

The job controller 401 is also connected to a reader control communication I/F 406 as a communication I/F with a CPU circuit, not shown, for controlling the scanner 102 for reading original images, and a clear coating apparatus control communication I/F 419 as a communication I/F with the clear coating apparatus 200.

Further, the job controller 401 is connected to a PDL control communication I/F 407 as a communication I/F with a CPU circuit of a PDL image controller, not shown, for expanding PDL image data received e.g. from a PC (personal computer), not shown, into a bitmap image.

Furthermore, the job controller 401 is connected to an image controller 402 that controls image data based on which a PDL image and a reader image are delivered to each of developing stations of the image forming apparatus 100, and a print controller 411 that drivingly controls the loads to form images. In short, the job controller 401 controls the overall operation of the image forming apparatus 100.

The image controller 402 is a circuit that configures image-related circuits according to a job generated by the job controller 401. In the present embodiment, the image controller 402 receives PDL image data via a PDL image I/F 408, and reader image data from a reader image I/F 409.

The image controller 402 sets an image selector 410 that determines which of the PDL image data and the reader image data is to be validated, and determines which area in an image memory 403 implemented by a volatile memory is to be used for storing the image data selected by the image selector 410, as data to be validated.

Further, the image controller 402 configures an image storage section 405 formed by a nonvolatile memory, typically an HDD, and performs configuration of an image compression/expansion section 404 for causing the same to compress bitmap image data received from the image memory 403 and send the compressed bitmap image data into the image storage section 405. The image controller 402 also performs configuration of the image compression/expansion section 404 for causing the same to expand compressed image data received from the image storage section 405 and send the expanded image data to the image memory 403.

Further, the image controller 402 reads out color image data from the image memory 403 so as to actually develop and print the image data, and causes an image processing section 414 to perform desired image processing. The image processing section 414 receives and performs image processing on image data of each color delivered from the image memory 403 based on settings of the image controller 402 configured according to instructions from the job controller 401.

Further, the image controller 402 configures LUTs (Look-Up Tables) 415 such that the sensitivity characteristics of the photosensitive drum 111 is reflected on the image data.

More specifically, when an image cannot have a desired density due to change of the sensitivity characteristics of the photosensitive drum 111 or a change in the amount of laser exposure or the amount of electric charge from the primary electrostatic charger 112, each of the LUTs 415 changes the image density of input each color image data, whereby the image is converted into an image having the desired density. Each color image data having passed through an associated one of the LUTs 415 is output to an associated one of the lasers 416, and an electrostatic latent image is formed on the photosensitive drum 111 by an associated one of the developing devices 113 to 116.

Further, the print controller 411 controls a sheet conveyance controller 412 in a manner synchronous with control of a print image controller 413, such that a full-color toner image formed on the intermediate transfer member 118 is transferred onto a sheet fed from one of the sheet feed cassettes 133 to 136. Furthermore, the print controller 411 provides control such that the transferred image is fixed on the sheet through the fixing device 145. First and second patch sensors 417 and 418 are connected to the print image controller 413.

Figure 4:
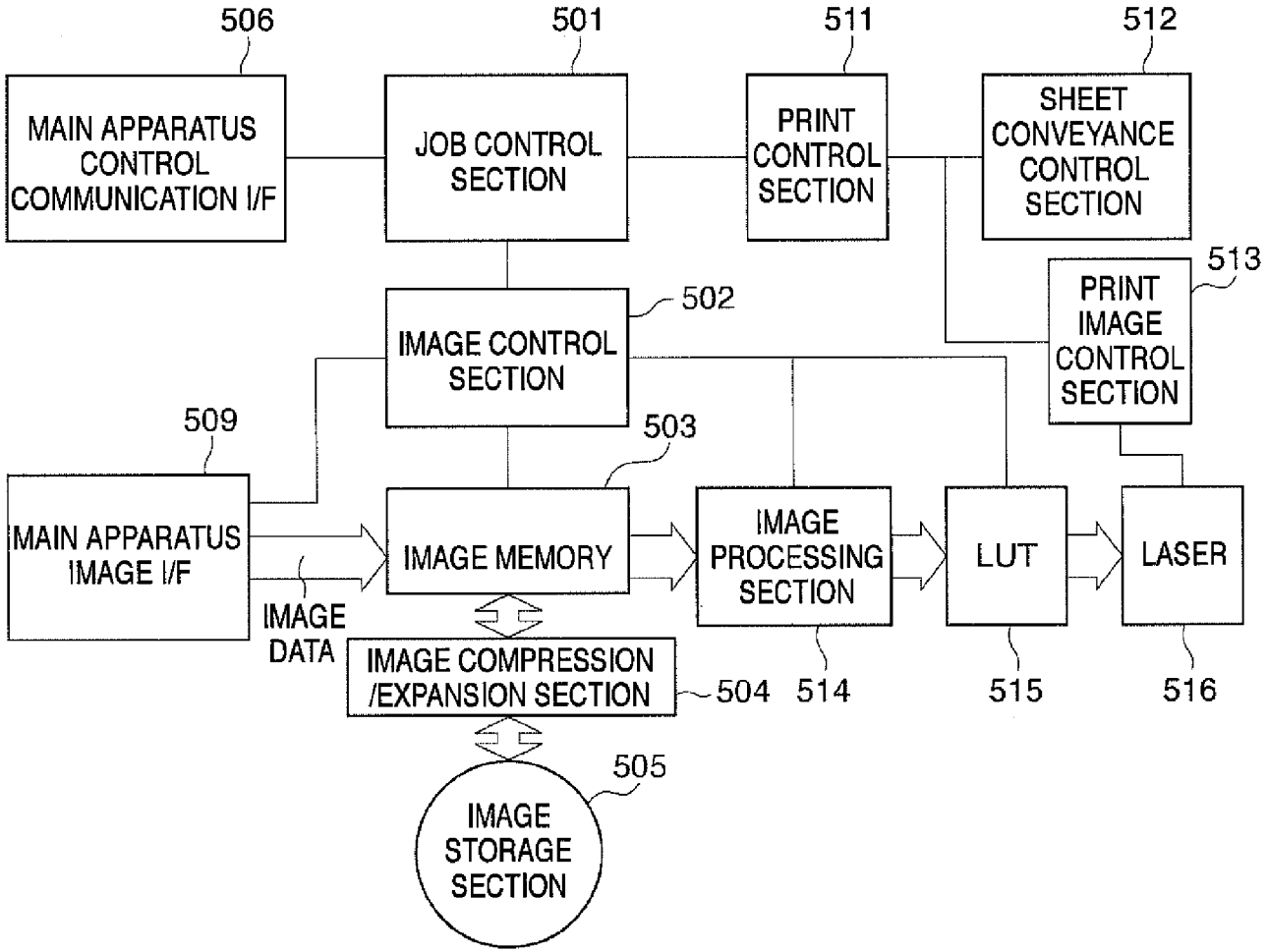
FIG. 4 is a schematic diagram of the circuit configuration of a clear coating apparatus appearing in FIG. 1.

FIG. 4 is a schematic diagram of the circuit configuration of the clear coating apparatus 200 in FIG. 1.

As shown in FIG. 4, a job controller 501 is a circuit including a ROM in which are written programs for controlling the clear coating apparatus 200, a RAM in which the programs are loaded, and a CPU that executes the programs.

A main apparatus control communication I/F 506 is connected to the job controller 501, and instructions issued from the main apparatus (image forming apparatus 100) are sent to the job controller 501 via the main apparatus control communication I/F 506.

A single-sided clear coating operation, a double-sided clear coating operation, and so forth are carried out according to operation mode information in the received instructions, based on a program stored in the job controller 501. The job controller 501 is connected to an image controller 502 and a print controller 511 that forms images by drivingly controlling loads.

The image controller 502 expands image data sent from the main apparatus via a main apparatus image I/F 509 into a bitmap image. The image controller 502 also configures image-related circuits according to a job generated by the job controller 501. In the present embodiment, image data sent to the image controller 502 via the main apparatus image I/F 509 is stored in an image memory 503.

Further, the image controller 502 configures an image storage section 505 formed by a nonvolatile memory, typically an HDD, and performs configuration of an image compression/expansion section 504 for causing the same to compress bitmap image data received from the image memory 503 and send the compressed bitmap image data into the image storage section 505. The image controller 502 also performs configuration of the image compression/expansion section 504 for causing the same to expand compressed image data received from the image storage section 505 and send the expanded image data to the image memory 503. Furthermore, the image controller 502 reads out clear coating image data from the image memory 503 so as to actually develop and print the image data, and causes an image processing section 514 to perform desired image processing.

The image processing section 514 receives image data of each color delivered from the image memory 503 based on settings of the image controller 502 configured according to instructions from the job controller 501, and performs image processing thereon to deliver the processed image data to LUTs 515.

Further, the image processing section 502 configures the LUTs 515 such that the sensitivity characteristics of a photosensitive drum 211 is reflected on the image data. When an image cannot have a desired density due to change of the sensitivity characteristics of the photosensitive drum 211 or a change in the amount of laser exposure or the amount of electric charge from a primary electrostatic charger 212, each of the LUTs 515 changes the image density of input each color image data, whereby the image is converted into an image having the desired density. Each color image data having passed through an associated one of the LUTs 515 is output to an associated one of lasers 516, and an electrostatic latent image is formed on the photosensitive drum 211 by the developing device 213.

Further, the print controller 511 controls a sheet conveyance controller 512 in a manner synchronous with control of the print image controller 513, such that a clear toner image formed on an intermediate transfer member 218 is transferred onto a sheet conveyed from the image forming apparatus 100. Furthermore, the print controller 511 provides control such that the transferred image is fixed on the sheet through a fixing device 245.

Figure 5:
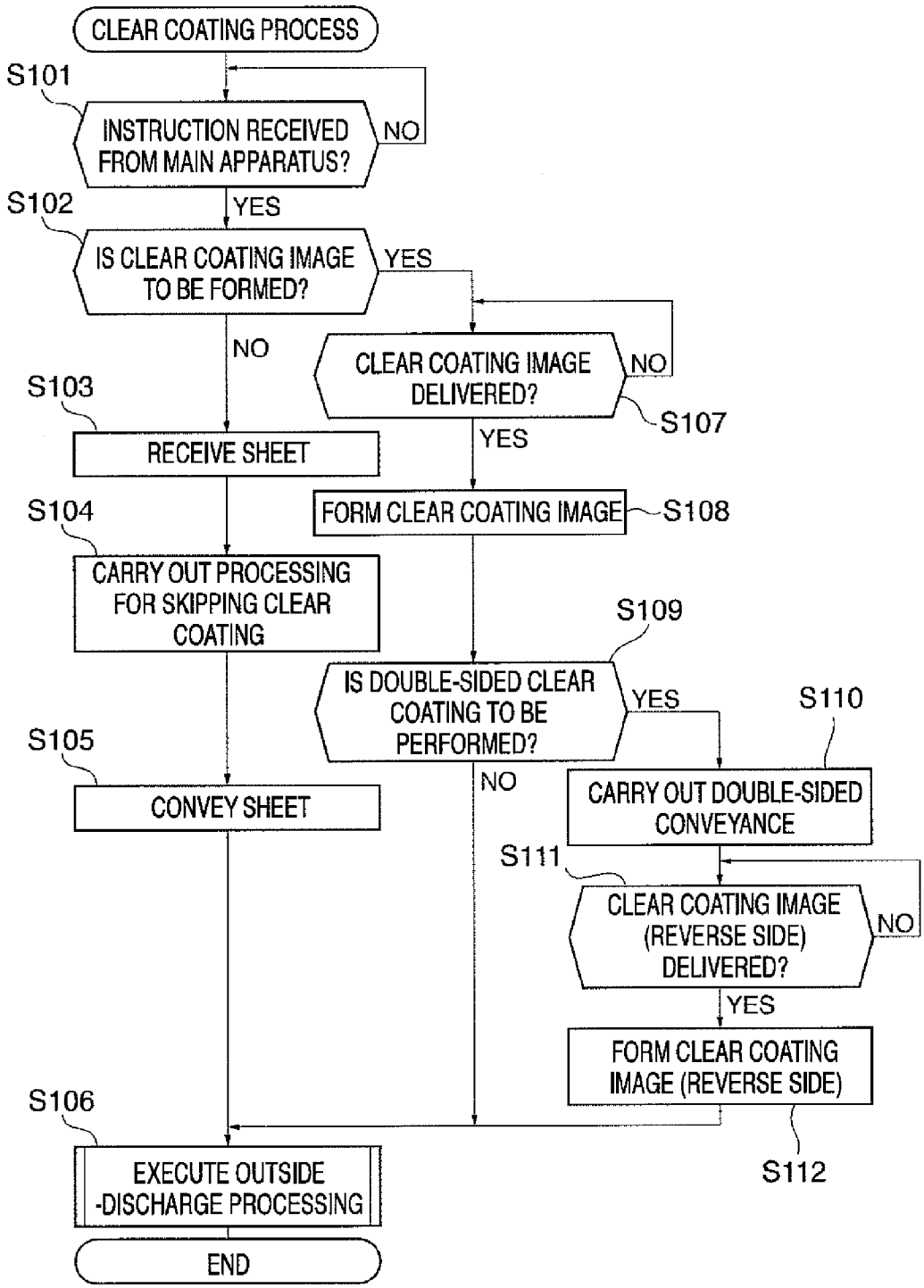
FIG. 5 is a flowchart of a clear coating process executed by the image forming system in FIG. 1.

FIG. 5 is a flowchart of a clear coating process executed by the image forming system shown in FIG. 1.

The present process is executed by the job controller 401 in FIG. 3 and the job controller 501 in FIG. 4.

Referring to FIG. 5, it is checked in a step 5101 whether or not a request for an operation has been received from the main apparatus (image forming apparatus 100). This step is repeatedly carried out before an operation is started.

When a request for an operational arrives, the process proceeds to a step S102, wherein it is determined, based on instruction data sent from the image forming apparatus, whether or not clear coating is to be performed. If clear coating is to be performed, the process proceeds to a step S107, whereas if not, the process proceeds to a step S103. In the step S103, sheet passing processing is carried out so as to discharge a sheet from the apparatus without carrying out clear coating, and then the process proceeds to a step S104. In the step S104, processing for skipping clear coating is executed, and then the process immediately proceeds to a step S105.

In the step S105, the sheet is conveyed without undergoing any processing, and if an instruction for inverted discharge has been received, the sheet is inverted, followed by the process proceeding to a step S106. In the step S106, outside-discharge processing is executed. Although a detailed description is omitted, if a device for passing a sheet out of the apparatus is provided, the processing by the device is executed, whereas if not, control is performed in consideration of stacking performance, followed by terminating the process.

In the step S107, image passing from the image forming apparatus 100 is executed (if there is no image, this step is skipped). When there is no image, a whole surface of a sheet can be covered by a clear coating image, for example). Next, in a step S108, clear coating is performed on the sheet in the same manner as image formation is performed in a normal image forming process.

In a step S109, it is determined whether or not double-sided clear coating is to be performed. If double-sided clear coating is to be performed, the process proceeds to a step S110, whereas if not, the process immediately proceeds to the outside-discharge processing (step S106).

In the step S110, the sheet is conveyed to a double-sided conveying section, and clear coating image data for the reverse side of the sheet is acquired. The processing, including double-sided conveyance, in this step is similar to that carried out by the image forming apparatus 100, and hence detailed description thereof is omitted. Then, the process proceeds to a step S111, wherein it is determined whether or not clear coating image data for the reverse side of the sheet has been passed (received). If the image data has been received, the process proceeds to a step S112. In the step S112, the same processing as executed in the step S108 is carried out. Then, the process proceeds to the step S106, followed by terminating the present process.

Figure 6:
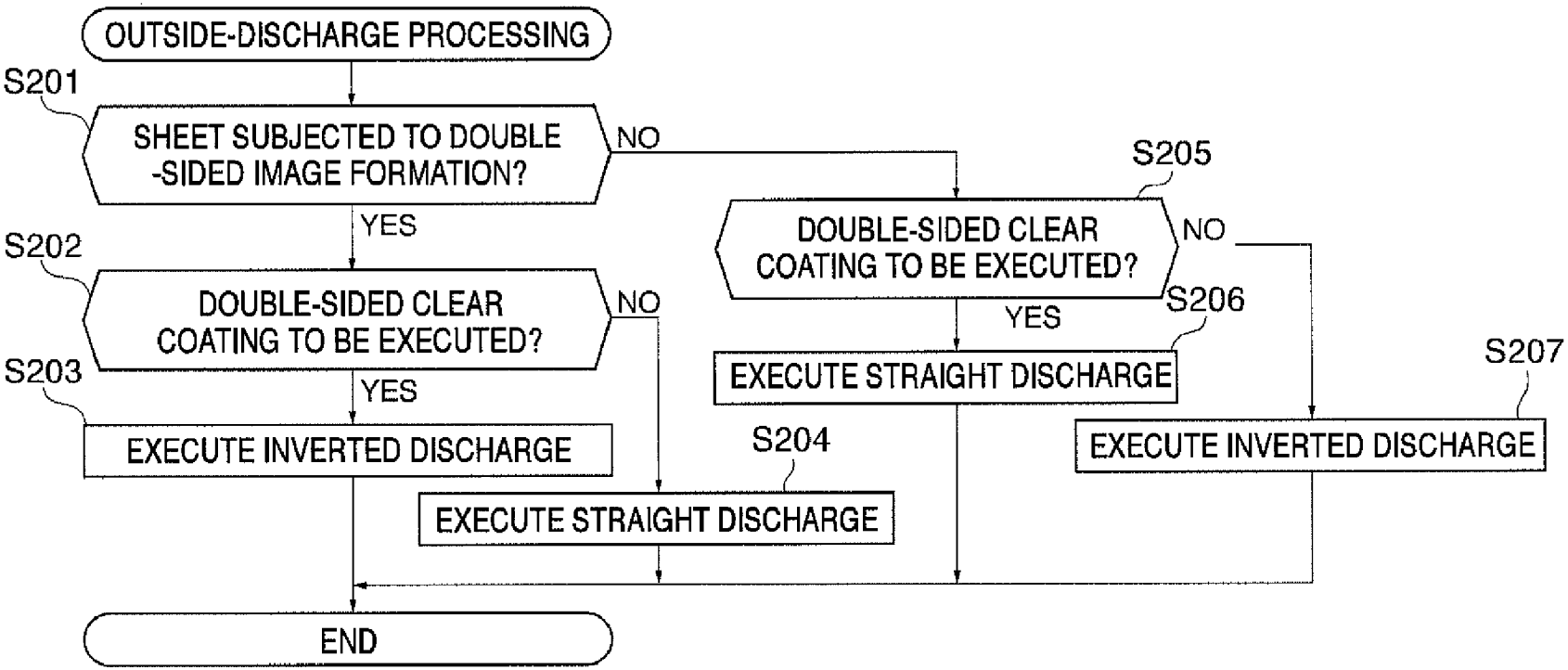
FIG. 6 is a flowchart showing a procedure of outside-discharge processing executed in a step S106 in FIG. 5.

FIG. 6 is a flowchart showing a procedure of outside-discharge processing executed in the step S106 in FIG. 5.

In FIG. 6, in a step S201, it is determined whether or not the sheet received from the image forming apparatus 100 has been subjected to double-sided image formation or single-sided image formation. If the sheet has been subjected to double-side image formation, the process proceeds to a step S202, whereas if the sheet is single-side image formation, the process proceeds to a step S205.

In the step S202, it is determined whether or not the sheet has been subjected to double-sided clear coating. If the sheet has been subjected to double-sided clear coating, the sheet received from the image forming apparatus 100 is inverted upside down, compared with the state of the sheet received from the image forming apparatus 100, and hence the process proceeds to a step S203, wherein the sheet is further inverted upside down to discharge the same out of the system, followed by terminating the present process. This operation causes the same surface of the sheet to face upward when discharged as when received from the image forming apparatus.

If it is determined in the step S202 that the sheet has not been subjected to the clear coating, the process proceeds to a step S204 since the same surface of the sheet remains to face upward as when received from the image forming apparatus, and hence the process proceeds to a step S204, wherein the normal discharge (straight discharge without sheet inversion) is carried out, followed by terminating the present process.

The step S205 is executed when the sheet received from the image forming apparatus 100 has been subjected to the single-side image formation, and it is determined whether or not the sheet has been subjected to the double-sided clear coating. If the sheet has been subjected to the double-sided clear coating, the sheet has been inverted upside down compared with when received from the image forming apparatus 100, causing the image-bearing side of the sheet to be changed from the upper side to the lower side, and hence the process proceeds to the step S206 to perform normal discharge, followed by terminating the present process.

It should be noted that even if the sheet is subjected to single-sided image formation, double-sided clear coating can be performed. By executing the step S06, when discharged sheets subjected to the double-sided clear coating are sequentially stacked, they are in a state discharged in proper order.

On the other hand, if it is determined that execution of single-sided clear coating or inhibition of any clear coating is requested, the process proceeds to the step S207, wherein the sheet is inverted upside down, and then discharged, followed by terminating the present process.

FIG. 7 is a diagram of a table showing the relationship between an image formation mode of the image forming apparatus, a clear coating mode of the clear coating apparatus, and an inverted discharge operation set to the clear coating apparatus. This table summarizes settings of execution or inhibition of the inverted discharge operation performed by the outside-discharge processing of the clear coating apparatus, which are configured according to the image formation mode of the image forming apparatus and the clear coating mode of the clear coating apparatus.

Figure 8:
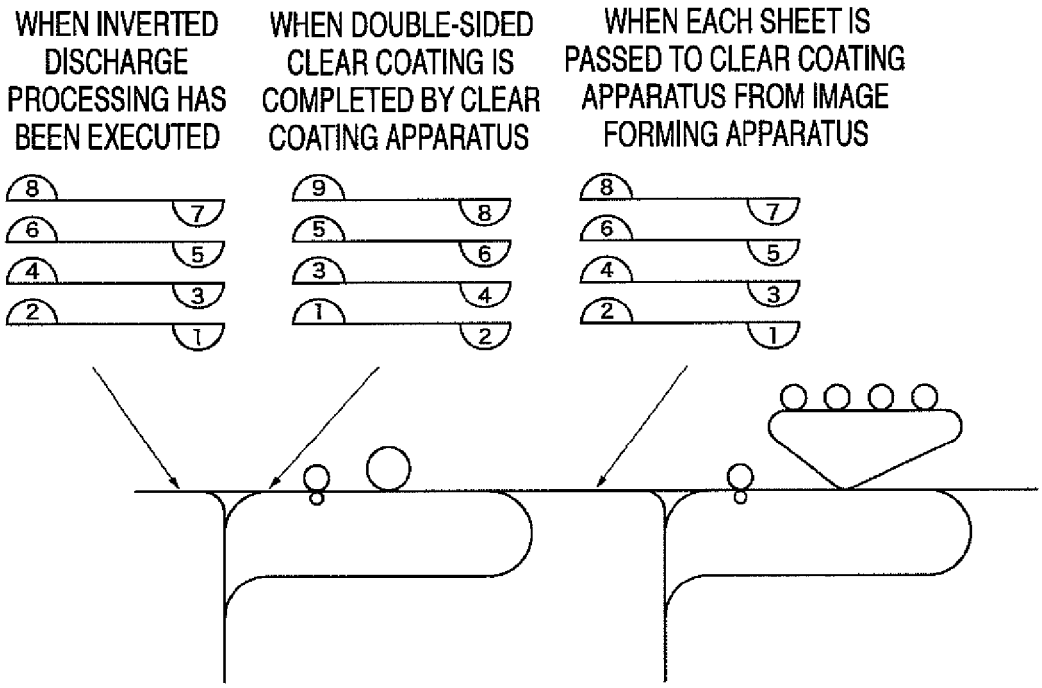
FIG. 8 is a diagram showing changes in the normal/reversed position of each sheet, which occur according to the present embodiment as the sheet is passed from the image forming apparatus after being subjected to double-sided image formation, subjected to double-sided clear coating, and then discharged out of the system after being subjected to inverted discharge processing.

FIG. 8 is a diagram showing changes in the normal/reversed position of each sheet, which occur according to the present embodiment as the sheet is received from the image forming apparatus after being subjected to double-sided image formation, subjected to double-sided clear coating, and then discharged out of the system after being subjected to inverted discharge processing.

The execution of the above-described processing makes it possible to discharge sheets out of the system while maintaining the proper page order, even when the clear coating apparatus 200 performs double-sided clear coating on the sheet subjected to double-sided image formation by the image forming apparatus 100.

Figure 9:
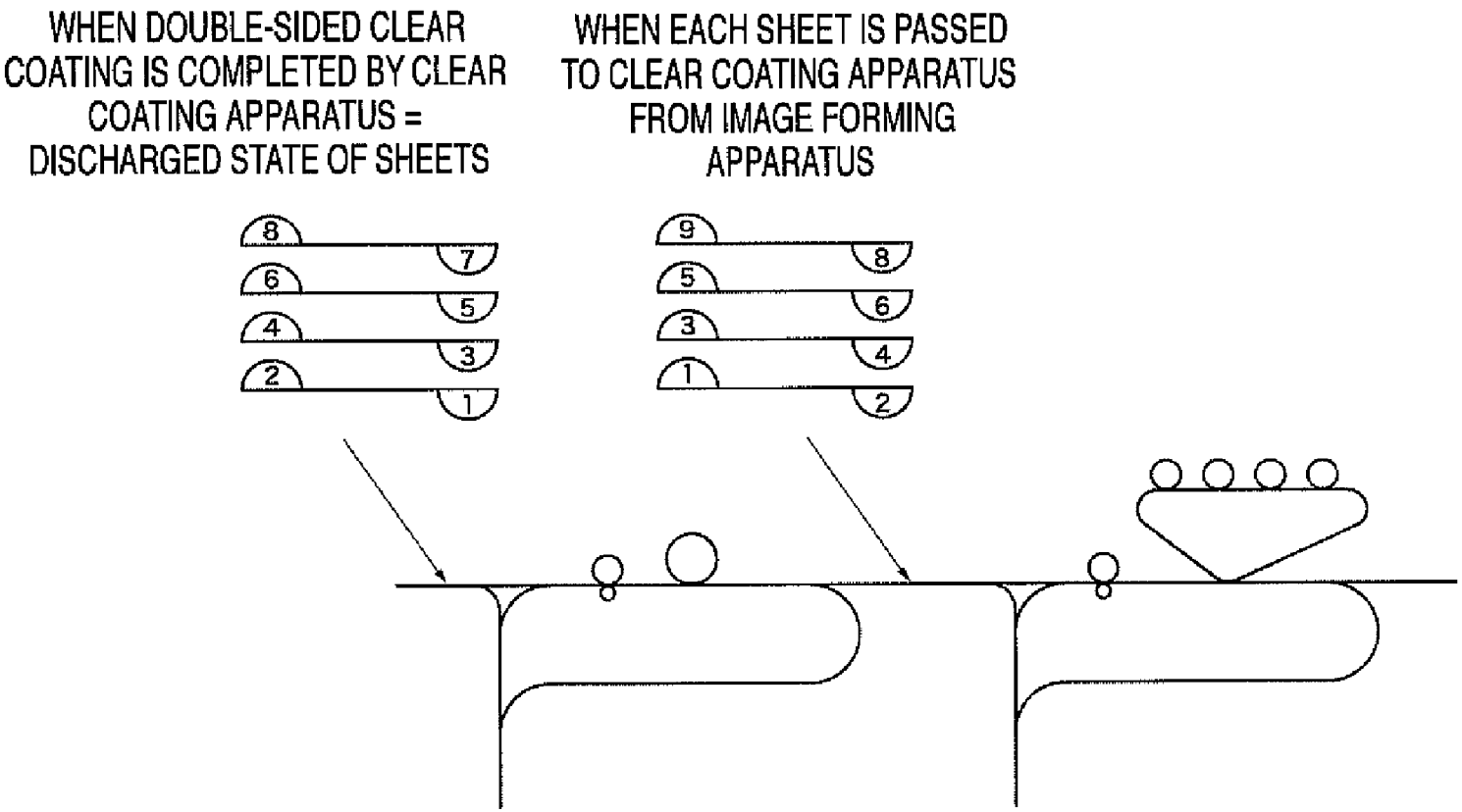
FIG. 9 is a diagram showing changes in the normal/reversed position of each sheet, which occur according to a variation of the present embodiment as the sheet is passed from the image forming apparatus after being subjected to double-sided image formation, subjected to double-sided clear coating, and then discharged out of the system.

FIG. 9 is a diagram showing changes in the normal/reversed position of each sheet, which occur according to a variation of the present embodiment as the sheet is received from the image forming apparatus after being subjected to double-sided image formation, subjected to double-sided clear coating, and then discharged out of the system. In this variation, when the sheet is subjected to double-sided image formation by the image forming apparatus 100 and clear coating by the clear coating apparatus 200, the image forming apparatus 100 first performs image formation on each sheet in inverted page order in advance, and then discharges the sheet to the clear coating apparatus 200.

As is apparent from FIG. 9, when the image forming apparatus 100 is requested to execute double sided image formation and the clear coating apparatus 100 is requested to execute double-sided clear coating, by configuring the system such that the image forming apparatus performs image formation on each of sheets in inverted page order in advance, the sheets are discharged out of the system with the page order properly maintained without further inverting each sheet upside down even when the clear coating apparatus 200 performs double-sided clear coating on each sheet.

Further, if the image forming apparatus has been requested to perform double-sided image formation and the clear coating apparatus 200 is not required to perform clear coating, by causing the image forming apparatus 100 to perform image formation on each of sheets in normal page order, it is possible to discharge the sheets out of the system while maintaining the proper page order, without further inverting each sheet upside down.

According to this variation, by performing the above-described processing, i.e. changing the page order of each sheet to be subjected to double-sided image formation, it is possible to discharge the sheets while maintaining the proper page order.

While the present invention has been described with reference to exemplary embodiments, it is to be understood that the invention is not limited to the disclosed the embodiments. The scope of the following claims is to be accorded the broadest interpretation so as to encompass all such modifications and equivalent structures and functions.

This application claims the benefit of Japanese Patent Application No. 2006-157296, filed Jun. 6, 2006, which is hereby incorporated by reference herein in its entirety.

What is claimed is:

1. A clear coating apparatus connectable to an image forming apparatus that performs image formation on sheets, the clear coating apparatus comprising:

a receiving section configured to receive the sheets from the image forming apparatus;

a clear image forming section configured to perform clear image formation on the sheets received by said receiving section using a clear toner;

an inverting section configured to invert each of the sheets upside down; and a controlling section configured to determine whether or not to control said inverting section to invert each of the sheets upside down, according to whether or not images are to be formed on both sides of each of the sheets by the image forming apparatus and whether or not clear images are to be formed on both sides of each of the sheets by said clear image forming section.

2. A clear coating apparatus as claimed in claim 1, wherein said controlling section controls said inverting section to invert each of the sheets upside down, in a case where the images are to be formed on both sides of each of the sheets by the image forming apparatus and the clear images are to be formed on both sides of each of the sheets by said clear image forming section.

3. A clear coating apparatus as claimed in claim 1, wherein said controlling section controls said inverting section to prevent each of the sheets from being inverted upside down in a case where the images are to be formed on both sides of each of the sheets by the image forming apparatus and the clear images are to be formed on only one side of each of the sheets by said clear image forming section.

4. A clear coating apparatus as claimed in claim 1, wherein said controlling section controls said inverting section to prevent each of the sheets from being inverted upside down in a case where the images are to be formed on only one side of each of the sheets by the image forming apparatus and the clear images are to be formed on both sides of each of the sheets by said clear image forming section.

5. A clear coating apparatus as claimed in claim 1, wherein said controlling section controls said inverting section to invert each of the sheets upside down in a case where the images are to be formed on only one side of each of the sheets by the image forming apparatus and the clear images are to be formed on only one side of each of the sheets by said clear image forming section.

6. A clear coating apparatus as claimed in claim 1, wherein said controlling section controls said inverting section to invert each of the sheets upside down in a case where the images are to be formed on only one side of each of the sheets by the image forming apparatus and none of the clear images is to be formed on each of the sheets by said clear image forming section.

7. A clear coating apparatus connectable to an image forming apparatus that performs image formation on sheets, the clear coating apparatus comprising:

a receiving section configured to receive the sheets from the image forming apparatus;

a clear image forming section configured to perform clear image formation on the sheets received by said receiving section using a clear toner;

an inverting section configured to invert each of the sheets upside down; and a changing section configured to change a page order of the sheets to be subjected to image formation by the image forming apparatus according to whether or not images are to be formed on both sides of each of the sheets by the image forming apparatus and whether or not clear images are to be formed on both sides of each of the sheets by said clear image forming section.

* * * * *